US009771676B2

(12) United States Patent
Huang et al.

(10) Patent No.: US 9,771,676 B2
(45) Date of Patent: Sep. 26, 2017

(54) FRONT-LOADING WASHING MACHINE

(71) Applicant: WUXI LITTLE SWAN CO., LTD., Wuxi (CN)

(72) Inventors: Mingde Huang, Wuxi (CN); Yusheng Tang, Wuxi (CN); Kyunghag Kim, Wuxi (CN)

(73) Assignee: WUXI LITTLE SWAN CO., LTD., Wuxi (CN)

( * ) Notice: Subject to any disclaimer, the term of this patent is extended or adjusted under 35 U.S.C. 154(b) by 0 days.

(21) Appl. No.: 15/340,828

(22) Filed: Nov. 1, 2016

(65) Prior Publication Data

US 2017/0218546 A1 Aug. 3, 2017

(30) Foreign Application Priority Data

Jan. 28, 2016 (CN) ..... 2016 1 0060717
Jan. 28, 2016 (CN) ..... 2016 2 0089031 U

(51) Int. Cl.

| | |
|---|---|
| ***D06F 37/30*** | (2006.01) |
| ***D06F 33/02*** | (2006.01) |
| ***D06F 37/04*** | (2006.01) |
| ***D06F 37/10*** | (2006.01) |
| ***D06F 39/08*** | (2006.01) |
| ***D06F 37/26*** | (2006.01) |
| ***D06F 39/12*** | (2006.01) |

(52) U.S. Cl.

CPC ..... *D06F 37/302* (2013.01); *D06F 33/02* (2013.01); *D06F 37/04* (2013.01); *D06F 37/10* (2013.01); *D06F 37/26* (2013.01); *D06F 37/267* (2013.01); *D06F 39/083* (2013.01); *D06F 39/085* (2013.01); *D06F 39/12* (2013.01)

(58) Field of Classification Search

CPC ..... D06F 37/26; D06F 37/267; D06F 37/302; D06F 39/083; D06F 39/085; D06F 39/12; D06F 33/02

See application file for complete search history.

(56) References Cited

U.S. PATENT DOCUMENTS

| | | | | |
|---|---|---|---|---|
| 3,199,319 | A * | 8/1965 | Lowes | D06F 23/00 68/210 |
| 5,442,937 | A | 8/1995 | Kwon | |
| 6,416,231 | B1 | 7/2002 | Verbrugge et al. | |
| 2003/0033963 | A1 | 2/2003 | Doyle | |

(Continued)

FOREIGN PATENT DOCUMENTS

| | | |
|---|---|---|
| JP | 2006288901 | 10/2006 |

*Primary Examiner* — Joseph L Perrin
(74) *Attorney, Agent, or Firm* — Hodgson Russ LLP

(57) ABSTRACT

The present disclosure discloses a front-loading washing machine including a cabinet, having a from panel, in which the front panel is provided with an opening; a tub having an access port for loading and unloading laundry, in which the tub is disposed in the cabinet and configured in such a manner that the access port is capable of being moved up and down in the opening; a rotatable drum, disposed in the tub; a door unit, mounted to the tub, and configured to cover the access port; and a driving mechanism configured to drive the tub to rotate, in which the driving mechanism is provided in the cabinet and coupled to the tub. The front-loading washing machine according to embodiments of the present disclosure has advantages of user-friendliness, little abrasion clothes and water conservation.

5 Claims, 4 Drawing Sheets

(56) References Cited

U.S. PATENT DOCUMENTS

| | | | | |
|---|---|---|---|---|
| 2004/0244438 | A1* | 12/2004 | North | D06F 25/00 68/23.2 |
| 2009/0315387 | A1 | 12/2009 | Smith | |
| 2012/0042697 | A1 | 2/2012 | Hong et al. | |
| 2012/0184401 | A1 | 7/2012 | Shepherd et al. | |
| 2015/0122967 | A1* | 5/2015 | Kim | D06F 37/302 248/550 |
| 2015/0184327 | A1* | 7/2015 | Kim | D06F 37/26 68/210 |
| 2015/0368849 | A1* | 12/2015 | Pessot | D06F 39/087 68/17 R |
| 2016/0076185 | A1* | 3/2016 | Chen | D06F 23/06 68/12.01 |
| 2016/0186371 | A1* | 6/2016 | Cinello | D06F 37/267 68/208 |

* cited by examiner

FRONT-LOADING WASHING MACHINE

This application claims priority to and benefits of Chinese Patent Application Serial No. 201610060717.4 filed with the State Intellectual Property Office of P. R. China on Jan. 28, 2016 and Chinese Patent Application Serial No. 201620089031.3 filed with the State Intellectual Property Office of P. R. China on Jan. 28, 2016, the entire contents of which are incorporated herein by reference.

FIELD

The present disclosure relates to a technical field of household appliances, and more particularly to a front-loading washing machine.

BACKGROUND

In the related art, a washing machine includes a front-loading washing machine and a pulsator type washing machine. When a pulsator type washing machine is used for washing clothes, the clothes need to be fully soaked in water, so the pulsator type washing machine is poor in water conservation. A user has to stoop and crouch for putting the clothes in or fetching them out when using the front-loading washing machine, so the front-loading washing machine is very inconvenient to use, particularly difficult for elderly people and other special populations to operate.

SUMMARY

The present disclosure seeks to solve at least one of the problems existing in the related art to at least some extent. Therefore, the present disclosure provides a front-loading washing machine which has advantages of user-friendliness, little clothes abrasion and water conservation.

The front-loading washing machine according to embodiments of the present disclosure includes a cabinet, having a front panel with an opening formed therein; a tub is disposed in the cabinet and configured in such a manner that the access port is capable of being moved up and down in the opening; a rotatable drum disposed in the tub; a rotatable drum, disposed in the tub; a door unit, mounted to the tub, and configured to cover the access port; and a driving mechanism configured to drive the tub to rotate, in which the driving mechanism is provided in the cabinet and coupled to the tub.

The front-loading washing machine according to embodiments of the present disclosure has advantages of user-friendliness, little clothes abrasion and water conservation.

In addition, the front-loading washing machine according to the embodiments of the present disclosure may further have following additional technical features.

According to some embodiments of the present disclosure, the driving mechanism drives the access port to move up and down between a non-washing-state position and a washing-state position in the opening.

According to some embodiments of the present disclosure, when the access port is located at the non-washing-state position, the access port is driven to move close to an upper edge of the front panel; and when the access port is located at the washing-state position, the access port is driven to move close to a lower edge of the front panel.

According to some embodiments of the present disclosure, the driving mechanism is configured to drive the access port to move upwards to approach the upper edge of the front panel and move downwards to approach the lower edge of the front panel.

According to some embodiments of the present disclosure, when the access port is located at the non-washing-state position, an included angle between a central axis of the access port and a horizontal plane is 45 degrees to 90 degrees; and when the access port is located at the washing-state position, the included angle between the central axis of the access port and the horizontal plane is 0 degree to 15 degrees.

According to some embodiments of the present disclosure, the driving mechanism includes a longitudinal pushrod disposed at a front side of the tub, a transverse shaft disposed at a rear side of the tub and coupled with the tub, and a support frame disposed to the cabinet and having a hole, in which the transverse shaft rotates in the hole of the support frame.

According to some embodiments of the present disclosure, the front-loading washing machine further includes a midway clothes-adding button, and a controller communicating with the midway clothes-adding button, the driving mechanism and the door unit, in which the controller controls the driving mechanism and the door unit according to an instruction of the midway clothes-adding button, a stage where the front-loading washing machine stays and a water level in the drum.

According to some embodiments of the present disclosure, the controller judges which one of a washing stage, a rinsing stage and a spinning stage the front-loading washing machine stays in when receiving the instruction of the midway clothes-adding button; if the front-loading washing machine is in the washing stage, it is allowable to add clothes, and if the front-loading washing machine is in the rinsing stage or the spinning stage, it is unallowable to add clothes.

According to some embodiments of the present disclosure, the controller judges whether the water level in the drum is higher than a pre-determined door-opening water level (i.e. a pre-determined water level at which the door is allowed to open) when it is allowable to add clothes; when the water level in the drum is higher than the pre-determined door-opening water level, the drum is controlled to drain, and when the water level in the drum is lower than the pre-determined door-opening water level, the driving mechanism is controlled to implement a clothes-adding action.

According to some embodiments of the present disclosure, when the controller controls the driving mechanism to implement the clothes-adding action, the driving mechanism drives the access port to move upwards and the door unit is unlocked; and when the clothes-adding action to the drum is finished, the door unit is locked, the driving mechanism drives the access port to move downwards, and the washing stave continues.

Additional aspects and advantages of the present disclosure will be given in part in the following descriptions, become apparent in part from the following descriptions, or be learned from the practice of the present disclosure.

Figure 1:
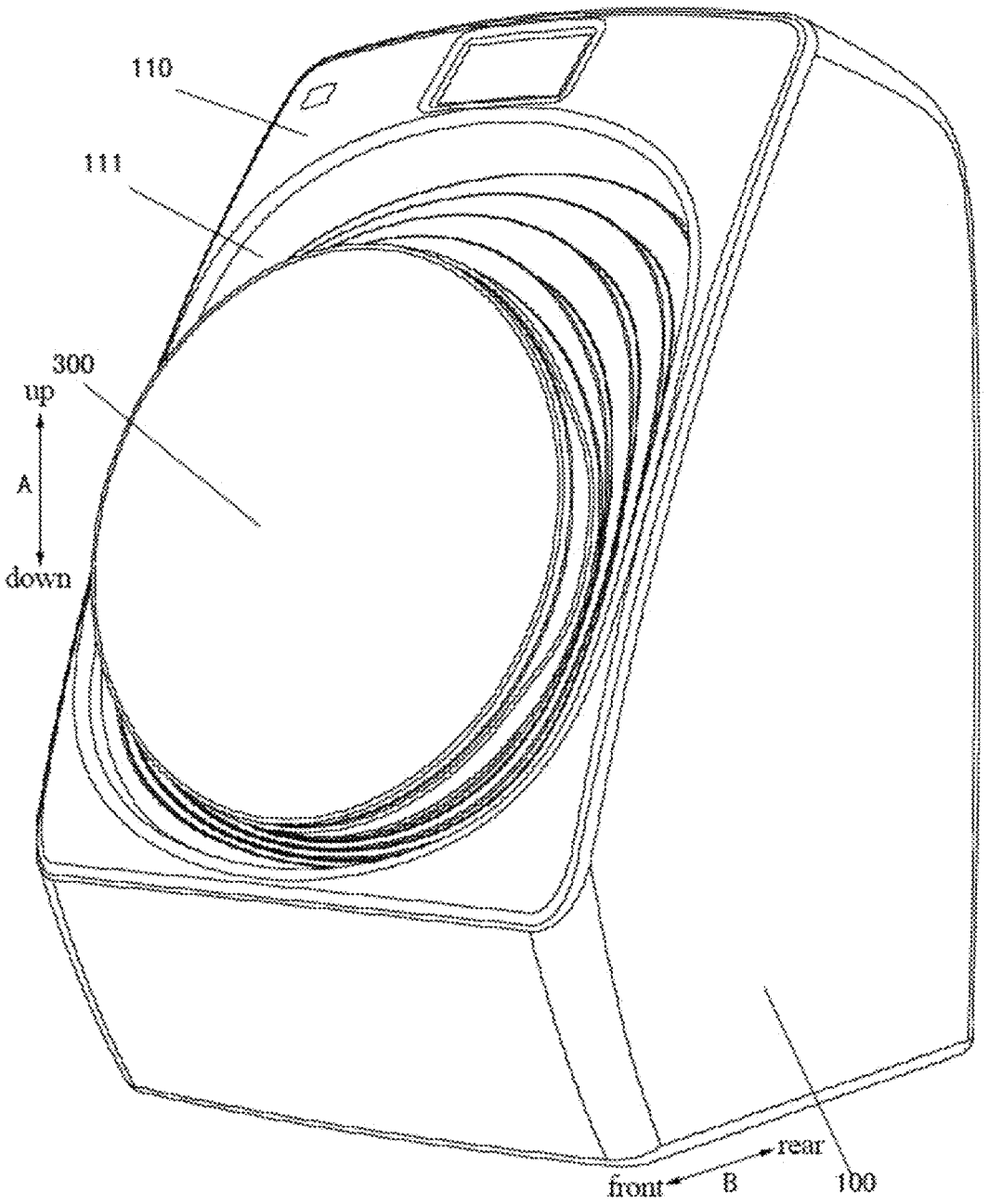
FIG. 1 is a schematic view of a front-loading washing machine according to an embodiment of the present disclosure, in which an access port is located at a washing-state position.

Reference Numerals:

front-loading washing machine 1:

cabinet 100; from panel 110; opening 111; tub 200; door unit 300; driving mechanism 400; longitudinal pushrod 410; transverse shaft 420; support frame 430; hole 431;

DETAILED DESCRIPTION

Reference will be made in detail to embodiments of the present disclosure. Examples of the embodiments are shown in the drawings. The embodiments described herein with reference to drawings are explanatory, and used to generally understand the present disclosure, and shall not be construed to limit the present disclosure.

In the following, a front-loading washing machine 1 according to embodiments of the present disclosure will be described with reference to the drawings.

As shown in FIG. 1 to FIG. 4, the front-loading washing machine 1 according to the embodiments of the present disclosure may include a cabinet 100, a tub 200, a rotatable drum (not shown in the figures), a door unit 300 and a driving mechanism 400.

The cabinet 100 has a front panel 110 (a front-and-rear direction as indicated by arrow B in FIG. 1 to FIG. 3), and the front panel 110 has an opening 111 formed therein. The tub 200 has the access port, and tub 200 is disposed in the cabinet 100 and configured in such a manner that the access port is capable of being moved up and down (an up-and-down direction as indicated by arrow A in FIG. 1 to FIG. 3) in the opening 111. The drum is disposed in the tub 200. The door unit 300 is mounted to the tub 200 and covers the access port. The driving mechanism 400 is used for driving the tub 200 to move, and the driving mechanism 400 is configured in the cabinet 100 and coupled with the tub 200.

In the front-loading washing machine 1 according to the embodiments of the present disclosure, by means of that the tub 200 is configured in such a manner that the access port is capable of being moved up and down in the opening 111, compared with a front-loading washing machine having an access port fixedly disposed in a front surface in the related art, the front-loading washing machine 1 can make the access port move to a suitable position for a user to put clothes in or take clothes out when the user is putting clothes in or taking clothes out. For example, the access port can be made to move upwards. In such a way, the user does not need to stoop or crouch when putting clothes in or taking clothes out, which not only is convenient for the user to put clothes in or take clothes out through the access port, but also makes people who cannot stoop easily, for example, the elderly put clothes in or take clothes out smoothly, thus improving convenience of the washing machine.

Furthermore, as the access port may move up and down in the opening 111, the access port can be moved to a position suitable for washing clothes after the clothes are put in. For example, the access port can be made to move downwards. In the process of washing the clothes, the drum can roll to drive the clothes to be beaten up and down so as to be washed, which not only reduces abrasion of the clothes, but also no longer needs to fully soak the clothes in water—instead, only needs a small amount of water for washing, thus reducing water consumption and facilitating environment protection.

In addition, the driving mechanism 400 is provided to drive the tub 200. The user can operate the driving mechanism 400 to drive the tub 200 when the user needs to adjust the position of the access port. Thus, the user can adjust the position of the tub 200 more effortlessly, 1) so as to facilitate adjustment of the position of the access port, further improving the convenience when users, like the elderly, use the washing machine 1. 2) so that it is convenient for the user to adjust the position of the tub 200, and further for the user (such as the aged) to use the front-loading washing machine 1.

That is, in the washing machine 1, the tub 200 is configured in such a manner that the access port is capable of being moved up and down in the opening 111, and the driving mechanism 400 is provided to drive the tub 200 to move. In such a way, the washing machine 1 can not only achieve a washing effect as a common front-loading washing machine when washing clothes, but also adjust the access port to a suitable position for putting clothes in, taking clothes out, or adding clothes halfway, which overcomes the problem that clothes cannot be conveniently put into or taken out from the front-loading washing machine in the related art, so the washing machine 1 is easy for the user to use and convenient to mount.

Accordingly, the front-loading washing machine 1 according to the embodiments of the present disclosure has the advantages of user-friendliness, little clothes abrasion and water conservation.

In the following, the front-loading washing machine 1 according to specific embodiments of the present disclosure will be described with reference to the drawings.

Figure 2:
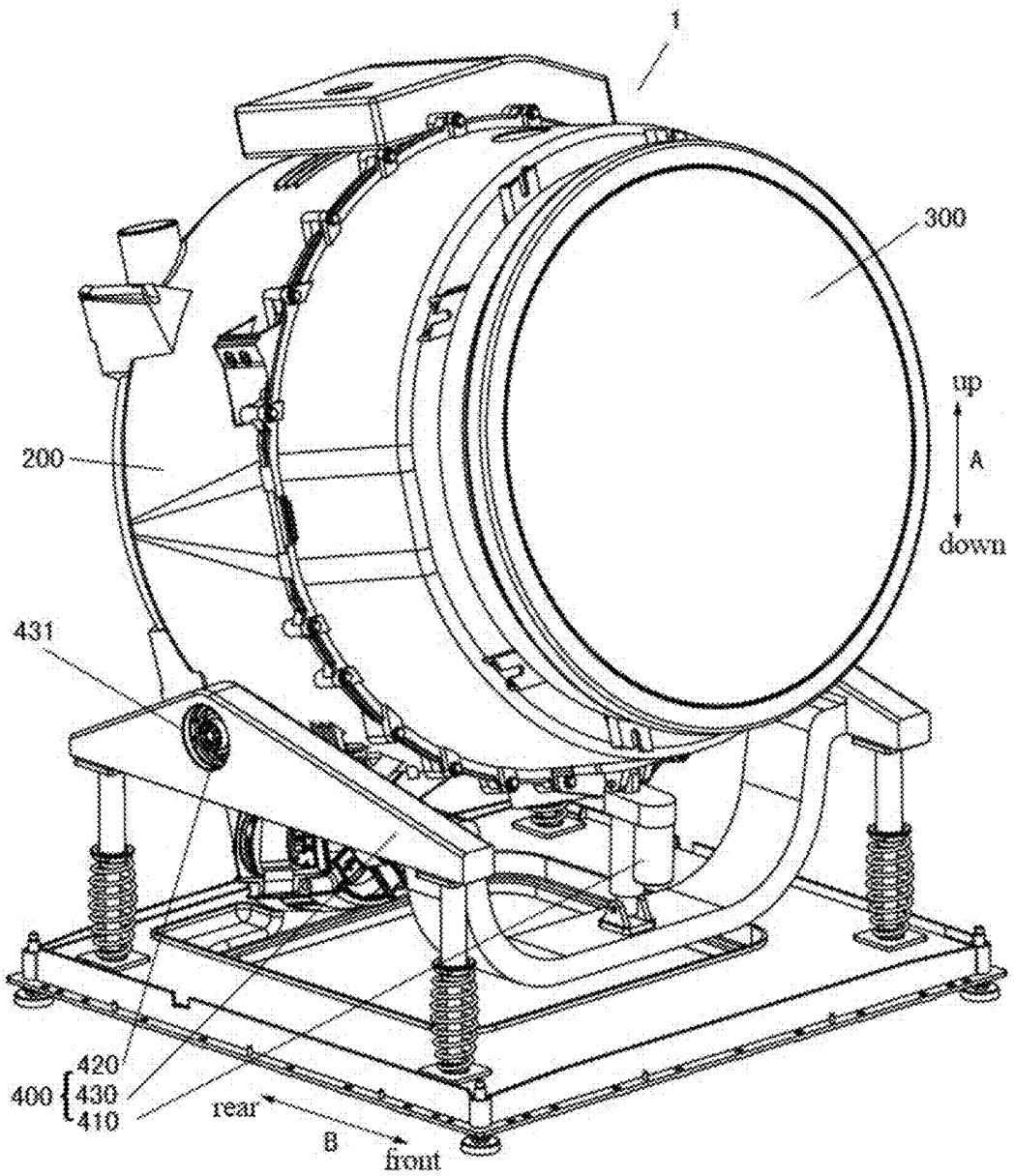
FIG. 2 is a partially schematic view of the front-loading washing machine according to the embodiment of the present disclosure, in which the access port is located at the washing-state position.
Figure 3:
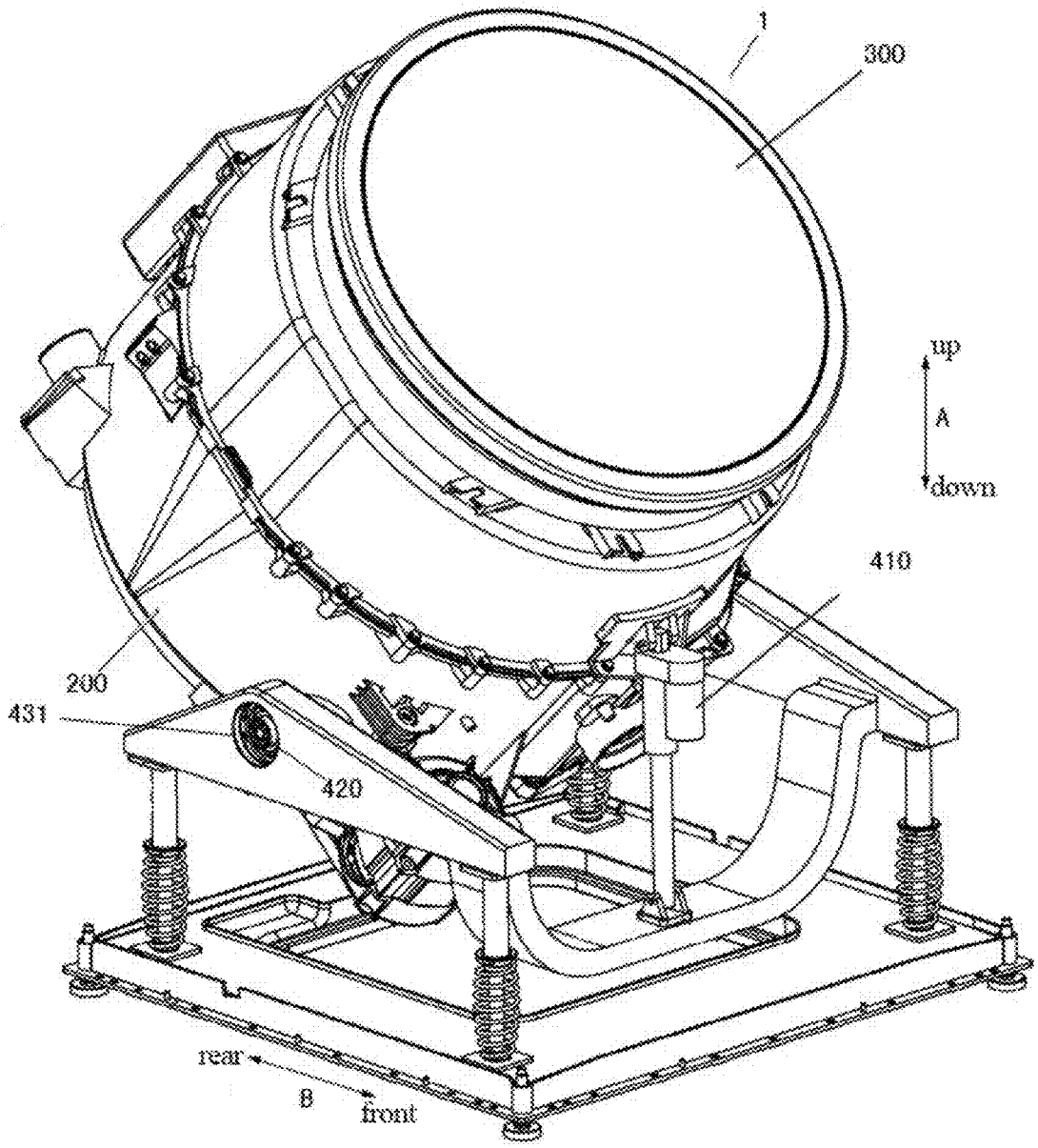
FIG. 3 is a partially schematic view of the front-loading washing machine according to the embodiment of the present disclosure, in which the access port is located at a non-washing-state position.

In some specific embodiments of the present disclosure, as shown in FIG. 1 to FIG. 3, the front-loading washing machine 1 according to the embodiments of the present disclosure includes the cabinet 100, the tub 200, the rotatable drum, the door unit 300 and the driving mechanism 400.

The driving mechanism 400 drives the access port to move up and down between a non-washing-state position and a washing-state position in the opening 111. Thus, the driving mechanism 400 can be used to drive the tub 200 to make the access port move to the washing-state position so as to wash clothes, when the clothes need washing; and the driving mechanism 400 can be used to drive the tub 200 to make the access port move to the non-washing-state position convenient for the user to put clothes in or take clothes out, when the clothes do not need washing.

In some preferable embodiments of the present disclosure, the front-loading washing machine 1 may further include a controller communicating with the driving mechanism 400. When the front-loading washing machine starts operating, the controller controls the driving mechanism 400 to drive the access port to move downwards; and when the front-loading washing machine stops operating, the controller controls the driving mechanism 400 to drive the access port to move upwards. Thus, the driving mechanism 400 can achieve an automatic control over the access port under the control of the controller without any manual operation, which is convenient to control and operate and has a higher automatic degree, easier to use and more effortless to operate.

Optionally, the controller may controls the driving mechanism to drive the access port to move upwards or downwards by controlling positive and negative of a direct current input to the driving mechanism 400. That is, operating states of the driving mechanism are different when positive and negative direct currents are input to the driving mechanism, so the states of driving the access port to move are different, thus realizing an upward movement or a downward movement of the access port. For example, in a specific example of the present disclosure, when the direct current input to the driving mechanism 400 is positive, the driving mechanism 400 can rotate forward and drive the access port to move upwards; when the direct current input to the driving mechanism 400 is negative, the driving mechanism 400 then rotates reversely and drives the access port to move downwards. The controller has a good controlling performance and is convenient to apply.

According to some specific embodiments of the present disclosure, the controller may include a first relay and a second relay. The first relay controls conduction and turn-off of the direct current input to the driving mechanism 400, and the second relay controls the positive and negative of the direct current input to the driving mechanism 400. That is, the first relay may control whether the direct current is switched on in the driving mechanism 400, and the second relay may change the positive and negative condition of the direct current, which can achieve a control over the direct current input to the driving mechanism 400 conveniently and has a good control performance, and the product is easy to manufacture.

In a specific embodiment of the present disclosure, when the first relay is closed and the second relay is disconnected, the driving mechanism 400 may drive the access port to move upwards; and when the first relay is closed and the second relay is closed, the driving mechanism 400 may drive the access port to move downwards. That is, when the first relay is closed, the direct current may be turned on in the driving mechanism 400, and at that moment the second relay is disconnected, so the positive and negative condition of the direct current input to the driving mechanism 400 will not be changed, and the access port may move upwards driven by the driving mechanism 400; when the second relay is closed, the positive and negative condition of the direct current input to the driving mechanism 400 will be changed, so that the access port is driven to move downwards.

Accordingly, by disposing two relays, a power-supply device for supplying power to the driving mechanism 400 can output one kind of direct current, without having to configure two kinds of direct current, which has a relatively low demand for the components and is low in cost and convenient to manufacture.

Optionally, maximum one-way time for the driving mechanism 400 to drive the access port to move upwards or downwards is a pre-determined adjustable time. That is, the time for the driving mechanism 400 to drive the access port to move from the non-washing-state position to the washing-state position is a pre-determined adjustable time T, and the time for the driving mechanism 400 to drive the access port to move from the washing-state position to the non-washing-state position is also the pre-determined adjustable time T. Thus, the operation is more convenient, and the times of upward movement and downward movement are same, which is advantageous for the access port to move in place and guarantees the normal operation of the washing machine. The pre-determined adjustable time T may be set flexibly according to specific conditions, and optionally, the pre-determined adjustable time T may be 3 seconds to 20 seconds. For example, the pre-determined adjustable time T may be 5 s, 10 s or 15 s. Thus, the movement time of the access port is suitable and the user may wait for a short time, the operation is convenient, and the washing machine has a good performance.

Furthermore, after the front-loading washing machine is powered and before it operates, the first relay is closed for the pre-determined adjustable time T and the second relay is disconnected; when the front-loading washing machine starts operating, the second relay is closed before the first relay, and the first relay and the second relay may be closed for the pre-determined adjustable time T simultaneously; and when the front-loading washing machine stops operating, the first relay is closed for the pre-determined adjustable time and the second relay is disconnected.

That is, when the front-loading washing machine is powered and before it starts to operate, i.e. when the front-loading washing machine is in a powered standby state, both the first relay and the second relay are in a disconnection state; at this moment, the first relay can be closed on the condition that the second relay keeps disconnected, and when the first relay is closed for the pre-determined adjustable time T, the access port can move to the non-washing-state position and the clothes can be put in through the access port conveniently; after the clothes is put in, a start button is pressed and a door lock is closed to lock the door unit 300, such that the front-loading washing machine starts to operate, and now the second relay may be closed; after the second relay is closed for a period of time t, the first relay is closed, and then the first relay and the second relay keep closed for the pre-determined adjustable time T simultaneously, in which case the access port can move to the washing-state position and the front-loading washing machine can start to implement the washing operation, in which t may be set according to practical requirements, for example, 5 seconds or less; when the washing procedure is finished, the first relay is closed on the condition that the second relay keeps disconnected, and when the first relay is closed for the pre-determined adjustable time T, the access port can move upwards to the non-washing-state position; and after the door is unlocked, the door unit 300 can be opened and the clothes washed can be taken out conveniently.

Accordingly, the access port can move smoothly and reliably, and especially when the access port moves downwards, the second relay is closed before the first relay, which can prevent the access port from being driven to move upwards caused by a late direction change of the direct current when it should move downwards, results in a reliable control and operation, and improve the security of using the front-loading washing machine.

As shown in FIG. 1 to FIG. 3, when the access port is located at the non-washing-state position (as shown in FIG. 3), the access port may move to approach an upper edge of the front panel 110. When the access port is located at the washing-state position (as shown in FIG. 1 and FIG. 2), the access port may move to approach a lower edge of the front panel 110. Hence, when the user needs to put in or take out the clothes, the access port can be moved to approach the upper edge of the front panel 110 to make it convenient for the user to put the clothes in or take them out from above; and when the user needs to wash the clothes, the access port can be moved to approach the lower edge of the front panel 110 to facilitate washing the clothes through rolling of the drum.

As shown in FIG. 1, the front panel 110 can incline backwards from the bottom up, so as to further make it convenient for the user to put the clothes in or take them out when the access port moves to the non-washing-state position.

Advantageously, as shown in FIG. 2 and FIG. 3, the driving mechanism 400 is configured to drive the access port to move upwards to approach the upper edge of the front panel 110 and move downwards to approach the lower edge of the front panel 110. When the user needs to put the clothes in or take them out, the user can operate the driving mechanism 400 to make the access port move upwards to approach the upper edge of the front panel 110, so as to adjust the position of the access port conveniently; and when the user needs to wash the clothes, the user can operate the driving mechanism 400 to make the access port move downwards to approach the lower edge of the front panel 110, so as to facilitate washing the clothes through rolling of the drum.

Optionally, the access port has a range of motion in the opening 111 configured in such a way that an included angle between a central axis of the access port and a horizontal plane is 0 degree to 90 degrees. In other words, the access port can move between a first position where the central axis thereof lies horizontally and a second position where the central axis thereof stands vertically. Specifically, when the access port is located at the non-washing-state position suitable for putting the clothes in or taking them out, the central axis of the access port can be oriented along a vertical direction; and when the access port is located at the washing-state position suitable for washing the clothes, the central axis of the access port can be oriented along a horizontal direction. Thus, it is not only convenient for the user to put in or take out the clothes from above, but also convenient to wash the clothes through rolling of the drum.

Those skilled in the related art should understand that the motion range of the access port can be adjusted according to actual needs. For example, when the access port is located at the non-washing-state position (as shown in FIG. 3), the central axis of the access port can incline forwards from the bottom up, which can also make it convenient for the user to put in or take out the clothes. When the access port is located at the washing-state position (as shown in FIG. 1 and FIG. 2), the central axis of the access port can be oriented at a predetermined angle relative to the horizontal direction on the premise that the clothes in the drum can be washed in a rolling way.

For example, according to some embodiments of the present disclosure, when the front-loading washing machine 1 is in the non-washing-state position, the included angle between the central axis of the access port and the horizontal plane may be 45 degrees to 90 degrees, such as 60 degrees, 70 degrees or 80 degrees. When the front-loading washing machine is in the washing-state position, the included angle between the central axis of the access port and the horizontal plane may be 0 degree to 15 degrees, such as 3 degrees, 7 degrees or 12 degrees. Thus, the front-loading washing machine is more convenient and flexible to use and easy to manufacture, and it is convenient to put clothes in and take clothes out, along with a good washing effect.

In some preferable embodiments of the present disclosure, the front-loading washing machine 1 includes a midway clothes-adding button and a controller, in which the controller may communicate with the midway clothes-adding button, the driving mechanism 400 and the door unit 30, and the controller may control the driving mechanism and the door unit 300 according to an instruction of the midway clothes-adding button, a stage where the front-loading washing machine stays and a water level in the drum T. Thus, the front-loading washing machine 1 according to embodiments of the present disclosure may have function of midway clothes-adding. In the operating process of the program, if clothes need to be added, the user only needs to press the midway clothes-adding button, and the front-loading washing machine can operate under the control of the controller so as to meet the demand of clothes-adding. The control performance is good, and the front-loading washing machine operates safely and reliably and is more flexible to use.

The controller can judge which one of a washing stage, a rinsing stage and a spinning stage the front-loading washing machine stays in when receiving the instruction of the midway clothes-adding button; when the front-loading washing machine is in the washing stage, it is allowable to add clothes, and when the front-loading washing machine is in the rinsing stage and the spinning stage, it is unallowable to add clothes. Thus, it is possible to avoid adding new clothes in the rinsing stage and the spinning stage, so as to prevent new added clothes from mixing with clothes ready to finish the washing and hence influencing the washing effect.

Further, the controller judges whether the water level in the drum is higher than a pre-determined door-opening water level (i.e. a pre-determined water level at which the door is allowed to open) when it is allowable to add clothes; when the water level in the drum is higher than the pre-determined door-opening water level, the drum is controlled to drain, and when the water level in the drum is lower than the pre-determined door-opening water level, the driving mechanism 400 is controlled to implement a clothes-adding action. Thus, it is possible to avoid opening the door unit 300 when the water level is high, so as to prevent an overflow and a too high water level caused by adding clothes from influencing the washing.

The pre-determined door-opening water level may be set according to demands, so as to guarantee that the water will not overflow when clothes are added to the drum on the condition that the tub 200 is raised up. For example, in some embodiments of the present disclosure, the pre-determined door-opening water level may be set in such a manner that the water level in the drum is lower than the lowest point of the access port for some distance, for example, more than 2 cm, when the tub 200 is raised up, so as to guarantee that the overflow will not occur when clothes are added. Actually, the pre-determined door-opening water level may be set according to a volume of the drum and a raised angle, which may be understood by those skilled in the art.

Furthermore, when the controller controls the driving mechanism to implement the clothes-adding action, the driving mechanism 400 drives the access port to move upwards and the door unit 300 is unlocked; and when the clothes-adding action to the drum is finished, the door unit 300 is locked, the driving mechanism 400 drives the access port to move downwards, and the washing stage continues. That is, when the controller judges that the front-loading washing machine allows a clothes-adding operation, the controller may control the driving mechanism 400 to drive the tub 200 to move upwards, the access port is driven to move to the non-washing-state position, the door unit 300 is controlled to be unlocked, and hence the user can open the door unit 300 and add new clothes to the drum through the access port; afterwards, the unit door 300 is locked, the driving mechanism 400 can control the tub 200 to rotate under the control of the controller, so as to make the access port move downwards to the washing-state position, in which case the tub 200 moves in place and the washing stage can continue. The clothes-adding operation is convenient to perform with a high automatic degree, and the front-loading washing machine operates safely and reliably and has a high flexibility.

As shown in FIG. 1 to FIG. 4, the driving mechanism 400 may include a longitudinal pushrod 410 disposed at a front side of the tub 200, a transverse shaft 420 disposed at a rear side of the tub 200 and coupled with the tub 200, and a support frame 430 disposed to the cabinet 100 and having a hole 431, in which the transverse shaft 420 rotates in the hole 431 of the support frame 430. The tub 200 can be rotatably disposed to the support frame 430 by the transverse shaft 420, to make the access port move up and down in the opening 111; and the tub 200 can be driven to move by the longitudinal pushrod 410, to implement adjustment of the position of the access port.

The longitudinal pushrod 410 can work under the control of the controller, and the power source the longitudinal pushrod 410 needs to move is direct current. A movement rod of the longitudinal pushrod 410 may push outwards at a uniform speed after powered on, in which case the longitudinal pushrod 410 pushes the tub 200 upwards, and when the tub 200 rises to the highest position, i.e. the access port moves upwards to the non-washing-state position, the longitudinal pushrod 410 may trigger a position limiting switch of the controller and the controller controls the longitudinal pushrod 410 to stop moving; if the positive and negative poles of the direct current are exchanged, the movement rod of the longitudinal pushrod 410 will pull backwards, in which case the longitudinal pushrod 410 pulls the tub 200 downwards, and when the tub 200 is pulled to the lowest position i.e. the access port moves downwards to the washing-state position, the longitudinal pushrod 410 may trigger the position limiting switch and the longitudinal pushrod 410 stops moving.

Figure 4:
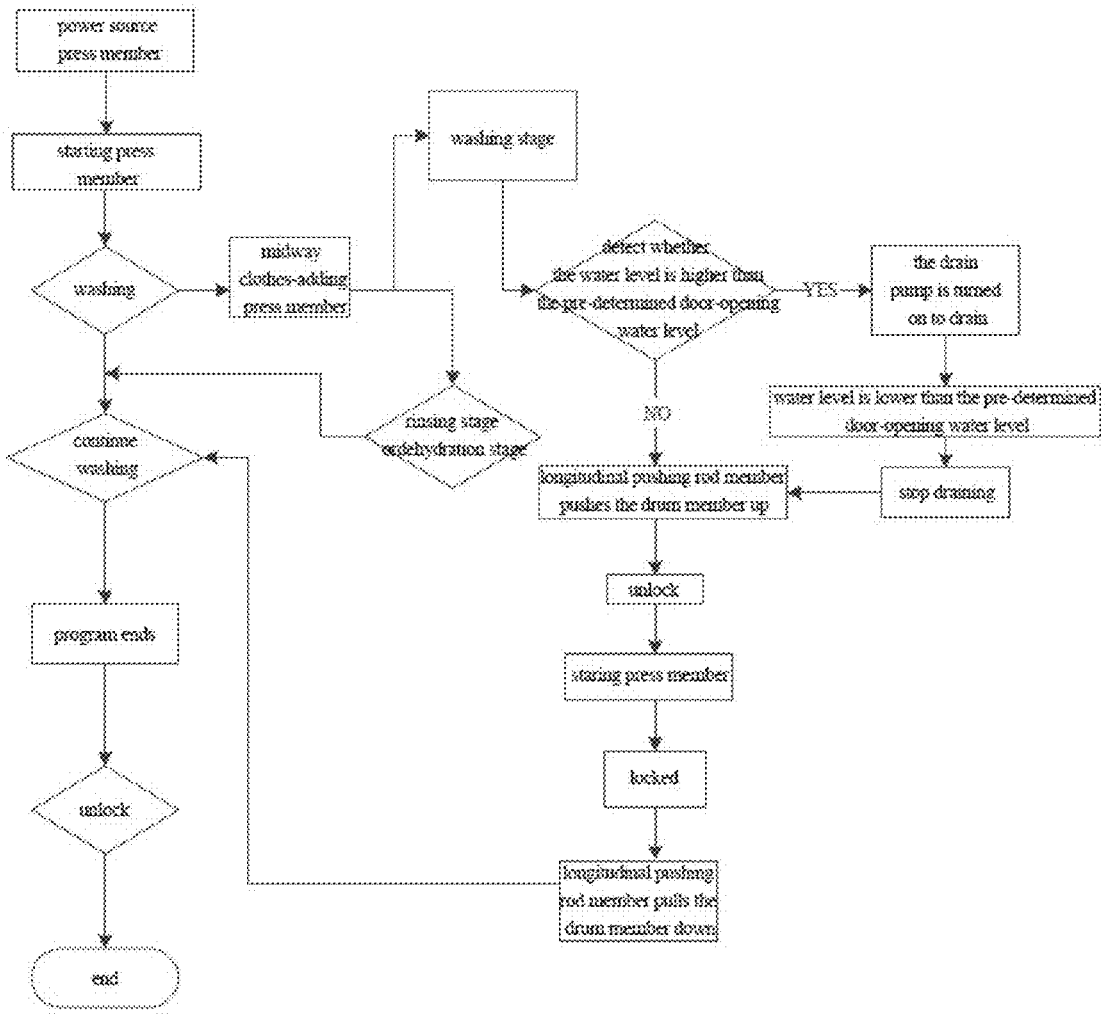
FIG. 4 is a control flow chart of the front-loading washing machine according to the embodiment of the present disclosure.

The front-loading washing machine 1 includes the midway clothes-adding button. In the operating process of the program, if clothes need to be added, the user needs to press the midway clothes-adding button, which is convenient to add clothes in midway. For the convenience of operation, the midway clothes-adding button may be disposed to the front panel 110 of the cabinet 100. As shown in FIG. 4, the front-loading washing machine 1 may make a midway clothes-adding judgment according to the following process.

When the midway clothes-adding button is pressed, the controller can judge the stage where the operation program stays at present. If the program stays in the final spinning stage, it is judged that the midway clothes-adding is not allowable, so the washing machine continues the spinning operation rather than implements the midway clothes-adding action; if the program stays in the rinsing stage, it is judged that the midway clothes-adding is not allowable, so the washing machine continues the rinsing operation rather than implements the midway clothes-adding action; if the program stays in the washing stage, the midway clothes-adding is allowable.

If it is judged that the midway clothes-adding action is allowable, it is first judged whether the water level in the drum is higher than the door-opening water level by a water level sensor. If the water level in the drum is higher than the door-opening water level, the drain pump is turned on to drain. The water level sensor can monitor the water level continuously in the process of draining and transmit the detection information to the controller. If it is detected that the water level in the drum is lower than the door-opening water level, the controller controls the drain pump to stop operating, and the drum stops draining; if it is detected that the water level in the drum is higher than the door-opening water level, the drain pump drains.

The controller may control the longitudinal pushrod 410 to push outwards, and when the tub 200 is pushed to a position where the access port is located at the non-washing-state position, the longitudinal pushrod 410 stops moving and the door lock is unlocked, so that the door unit 300 is unlocked and the access port can be opened to implement the clothes-adding operation. When the clothes-adding operation is finished, a start button can be pressed and the door lock is locked to make the door unit 300 be locked; the controller can control the longitudinal pushrod 410 to pull backwards, and when the tub 200 is pulled to position where the access port is located at the washing-state position, the longitudinal pushrod 410 stops moving and the washing process continues.

Other configurations and operation of the front-loading washing machine 1 according to embodiments of the present disclosure are known for those skilled in the art, which will not be described in detail herein.

In the specification, it is to be understood that terms such as "center," "upper," "lower," "front," "rear," "left," "right," "vertical," "horizontal," "top," "bottom," "inner", "outer" and "axial," should be construed to refer to the orientation as then described or as shown in the drawings under discussion. These relative terms are for convenience of description and do not require that the device or element be constructed or operated in a particular orientation, shall not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections or be communicated with each other; may also be direct connections or indirect connections via intervening structures; may also be inner communications or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an intervening structures.

Reference throughout this specification to "an embodiment," "specific embodiments," "an example," or "a specific example," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. Furthermore, different embodiments or examples in thus specification can be jointed and combined by those skilled in the art without mutual contradiction.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A front-loading washing machine, comprising:

a cabinet having a front panel, wherein the front panel is provided with an opening;

a tub having an access port for loading and unloading laundry, wherein the tub is disposed in the cabinet and configured in such a manner that the access port is capable of being moved up and down in the opening;

a rotatable drum, disposed in the tub;

a door unit mounted to the tub and configured to cover the access port; and a driving mechanism configured to drive the tub to rotate, wherein the driving mechanism is provided in the cabinet and coupled with the tub; and a midway clothes-adding button, and a controller communicating with the midway clothes-adding button, the driving mechanism, and the door unit;

wherein the controller is configured to control the driving mechanism to drive the tub to rotate between a washing-state position and a clothes-adding position and the door unit between a locked state and an unlocked state according to: an instruction of the midway clothes-adding button, a washing cycle stage, and a water level in the drum.

2. The front-loading washing machine according to claim 1, wherein the driving mechanism comprises a longitudinal pushrod disposed at a front side of the tub, a transverse shaft disposed at a rear side of the tub and coupled with the tub, and a support frame disposed to the cabinet and having a spindle hole, the transverse shaft rotating in the spindle hole of the support frame.

3. The front-loading washing machine according to claim 1, wherein the controller judges which one of a washing stage, a rinsing stage and a spinning stage the front-loading washing machine stays in when receiving the instruction of the midway clothes-adding button; if the front-loading washing machine is in the washing stage, it is allowable to add clothes, and if the front-loading washing machine is in the rinsing stage or the spinning stage, it is unallowable to add clothes.

4. The front-loading washing machine according to claim 3, wherein the controller judges whether the water level in the drum is higher than a pre-determined door-opening water level when it is allowable to add clothes; when the water level in the drum is higher than the pre-determined door-opening water level, the drum is controlled to drain, and when the water level in the drum is lower than the pre-determined door-opening water level, the driving mechanism is controlled to implement a clothes-adding action.

5. The front-loading washing machine according to claim 4, wherein when the controller controls the driving mechanism to implement the clothes-adding action, the driving mechanism drives the access port to move upwards and the door unit is unlocked; and when the clothes-adding action to the drum is finished, the door unit is locked, the driving mechanism drives the access port to move downwards, and the washing stage continues.

* * * * *